US005593117A

United States Patent [19]

Alexander, III

[11] Patent Number: 5,593,117

[45] Date of Patent: Jan. 14, 1997

[54] LEAF AND LAWN DEBRIS COLLECTING APPARATUS

[76] Inventor: Claibourne N. Alexander, III, 2025 Lee's Ct., Clearwater, Fla. 34624-4770

[21] Appl. No.: 514,482

[22] Filed: Aug. 11, 1995

[51] Int. Cl.[6] ..... B65B 67/04

[52] U.S. Cl. ..... 248/99; 248/95

[58] Field of Search ..... 248/95, 99, 101, 248/152; 294/1.1; 383/33; D9/434, 456

[56] References Cited

U.S. PATENT DOCUMENTS

| | | | |
|---|---|---|---|
| 2,462,973 | 3/1949 | Kelrick | 294/1.1 X |
| 3,934,803 | 1/1976 | Paulus, Jr. | 294/1.1 |
| 4,600,113 | 7/1986 | DeMars | 294/1.1 X |
| 4,629,233 | 12/1986 | Pfisterer | 294/1.1 |
| 4,643,380 | 2/1987 | Copeland | 248/97 |
| 4,659,045 | 4/1987 | Flynn | 294/1.1 X |
| 4,787,753 | 11/1988 | Barnhart | 383/33 |
| 5,028,022 | 7/1991 | Metcalf | 248/95 |
| 5,031,277 | 7/1991 | Coker | 294/1.1 X |
| 5,031,948 | 7/1991 | Groth et al. | 294/1.1 |
| 5,083,731 | 1/1992 | Fullilove | 294/1.1 X |
| 5,090,756 | 2/1992 | Pfisterer | 248/95 X |
| 5,393,022 | 2/1995 | Palumbo | 248/95 |
| 5,413,394 | 5/1995 | Mitchell | 294/1.1 |
| 5,498,046 | 3/1996 | Ridley, Sr. et al. | 294/1.1 |

*Primary Examiner*—Leslie A. Braun
*Assistant Examiner*—Sandra Snapp

[57] ABSTRACT

A lawn and garden debris collecting apparatus comprising primarily of a two component funnelled receiver and a permanent, reusable bag or a conventional trash bag. The mouth of the bag is held open by the apparatus therebetween the forward component and the rear component with a flexible strap joining together the two components. The funnelled receiver is normally placed on the ground with the bag attached thereto. Leaves from a lawn or the like is then raked into the funnelled receiver and channeled therethrough into the bag. A cut out hand hold is further included to seat the leaves and debris as needed as well as strategically repositioning and to allow the apparatus to be hung vertically from a protruding nail on a wall or the like.

9 Claims, 5 Drawing Sheets

LEAF AND LAWN DEBRIS COLLECTING APPARATUS

BACKGROUND OF INVENTION

1. Field of the Invention

Generally, this invention is directed towards collecting primarily leaves as well as other debris from a lawn, garden or the like. More specifically, this invention provides a two component funnelled receiver with a means for attaching a reusable bag or conventional trash bag thereto thereby allowing lawn debris to be collected from the ground into the type of bag desired for disposition intentions.

2. Description of the Prior Art

One of the problems noticed when trying to collect lawn debris into conventional trash bags is that trying to maintain an open mouth of the trash bag is a tricky and difficult task. Normally an additional person is required to facilitate this task when collecting lawn debris.

A further problem when trying to collect lawn debris is that the leaves and debris normally are raked into piles and then must be picked up and placed into the trash bag. This lacks efficiency in that each pile has to be re-raked two or more times to complete the task, thus increasing the number of times a person must bend over and pick up the debris. This also poses a problem when dealing with debris that is hazardous to a person's health.

Several approaches have been provided for the collection of lawn debris into conventional trash bags, in U.S. Pat. No. 5,129,609, "A flexible trash bag support apparatus adapted for use with conventional trash bags. The apparatus includes a substantially rigid flat back, two foldably connected side members, and trash bag holding slots which can secure trash bags in the desired position. The back may include an extension rendering it taller than the two side members so as to serve as a backboard for allowing refuse thrown at the bag to be deflected thereinto. Additionally, the surface of the back and side members may be coated with a conventional waterproof substance to protect them from damage and increase the life span of the apparatus. The apparatus as thus described is a sage and efficient method of supporting trash bags, and is novel in its method and apparatus for achieving this result."

In U.S. Pat. No. 5,106,041, "A trash bag holder for holding open the mouth of a trash bag to facilitate filling with trash being a generally triangular frame in which one side is a rectangular panel and the other sides are two resilient rods joined together at two ends and whose other ends join opposite ends of the panel. The triangular frame is inserted into the mouth of the bag to maintain the mouth open. A gripper/connector acting with force from the resilient rods secures the lip of the bag to the frame. The holder and bag may be laid on the ground in order to rake debris into the bag or hung from a spike in a wall or post for loading in the vertical position."

In the art taught by U.S. Pat. No. 5,222,536, "A refuse collector for introducing solid refuse into commercial plastic trash bags is disclosed. The collector includes an open, peripheral frame having a collection tray hinged thereto, and a pair of expanded arms that extend rearwardly from the frame and into a plastic trash bag to hold the bag open. The collector is particularly adapted to collection of hazardous solid waste such as metal chips or refuse contaminated toxic or infectious materials. The collector may be used in a horizontal or vertical position, and folds into a compact configuration for storage."

In U.S. Pat. No. 5,107,666, "A scoop allows one to readily collect leaves and like lawn debris form a grassy area. The scoop has a tubular end with handles extending from either side of the tubular end. A plastic bag is releasably connected to the tubular end as by laying the open mouth of the bag over a groove, with a rubber gasket, on the exterior surface of the tubular end, and clamping the open mouth of the bag into place. The handles of the scoop are grasped by the user, and the scoop is moved into the pile of leaves and like debris to force the debris through the tubular portion of the scoop in the plastic bag. Once the plastic bag is filled it is disconnected from the tubular end by unclamping the clamp, and replaced with another bag. The entire scoop, with the exception of the clamp (which may be a companiform ring), is an integral piece of ABS plastic."

While some of the prior art may contain some similarities relating to the present invention, none of them teach, suggest or include all of the advantages and unique features as the invention disclosed herein.

SUMMARY OF THE INVENTION

The present invention is directed towards allowing a single person to collect leaves and other lawn debris into a reusable, permanent collection bag or a conventional trash bag in a simple and quick fashion. The invention will allow a standing person to rake leaves into a bag with out requiring the person to bend over and pick up the leaves as is done in the conventional manner. The invention provides a two component funnelled receiver that will easily allow leaves and debris to be channeled into the bag while the mouth of the bag is held open by the two component receiver.

Accordingly, it is an object of this invention to provide a light weight leaf and lawn debris collecting apparatus that will connect with a reusable, permanent collection bag or a conventional trash bag and maintain the mouth of the bag in an open fashion.

Another object of this invention is to provide a funnelled receiver comprising of two components, a forward component and a rear component. The forward component having a flared front opening with a front side and a rear side, and the rear component with a front side and a rear side.

Still another object of this invention is to provide a funnelled receiver that will facilitate leaves and debris to enter the mouth of the bag. The funnelled receiver is designed to be placed upon the ground and be self supporting while maintaining the mouth of the bag in an open fashion.

Still another object of this invention is to provide a funnelled receiver having a plane angle shaped bottom that will allow debris to easily enter the bag and impede the same from exiting the bag.

A further object of this invention is to provide a top portion that is recessed allowing additional working space for a conventional rake to efficiently rake leaves and debris deep into the entrance of the funnelled receiver. The recessed top portion further contains a cut out hand hold located at the front edge of the funnelled component which is a given distance away from the center of mass. Lifting the hand hold upwards will cause the front component to tilt and thereby dump leaves towards the rear into the bag portion of the apparatus.

Still yet another object of this invention is to provide a means of affixing the mouth of a bag to the funnelled receiver. The mouth of the bag is secured between the two components using devices such as flexible straps.

A further object of this invention is to provide a hand hold that will allow a person to easily move the invention to an appropriate location. For storage purposes, the hand hold will also allow the apparatus to be hung in a substantially vertical fashion from a protruding spike such as a nail or the like.

Still a further object of this invention is to provide a funnelled receiver made from corrugated paper or corrugated plastic that can be easily and inexpensively manufactured. In using corrugated paper, a moisture resistive coating is typically applied thereon to make the corrugated paper impervious to moisture.

BRIEF DESCRIPTION OF THE DRAWINGS

This invention, together with other objects, features, aspects and advantages thereof, will be more clearly understood from the following description, considered in conjunction with the accompanying drawings.

Five sheets of drawings are furnished, sheet one contains FIG.1, sheet two contains FIG. 2 and FIG. 3, sheet three contains FIG. 4 and FIG. 5, sheet four contains FIG. 6 and FIG. 7, and sheet five contains FIG. 8 and FIG. 9.

DESCRIPTION OF THE PREFERRED EMBODIMENTS

Figure 1:
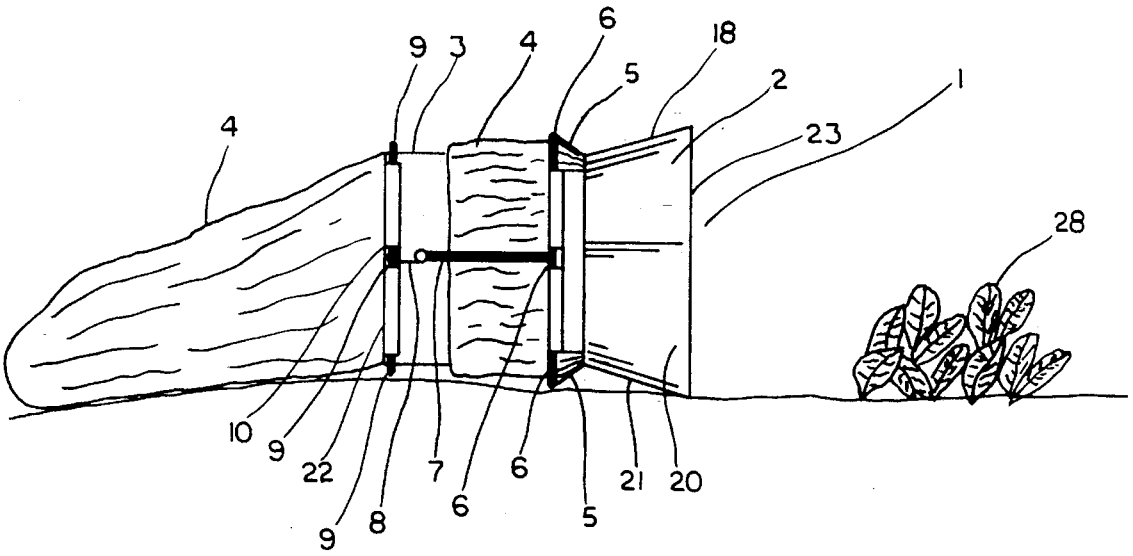
FIG. 1 is a side view of the funnelled receiver lying on the ground having a trash bag affixed thereto.
Figure 2:
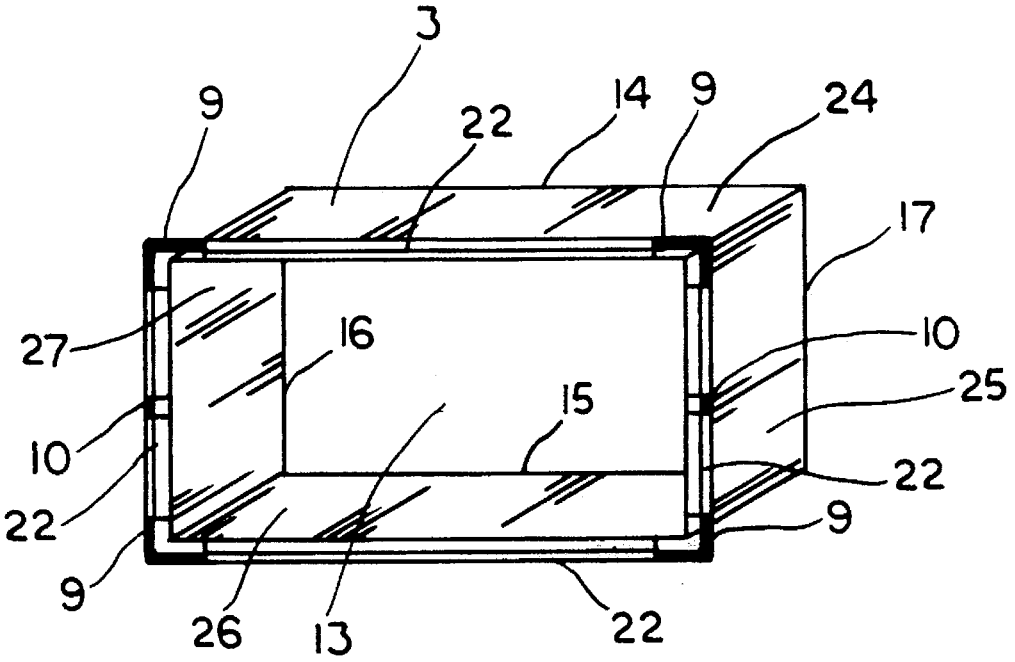
FIG. 2 shows an orthographic view of the rear component of the invention having a substantially rectangular configuration.
Figure 3:
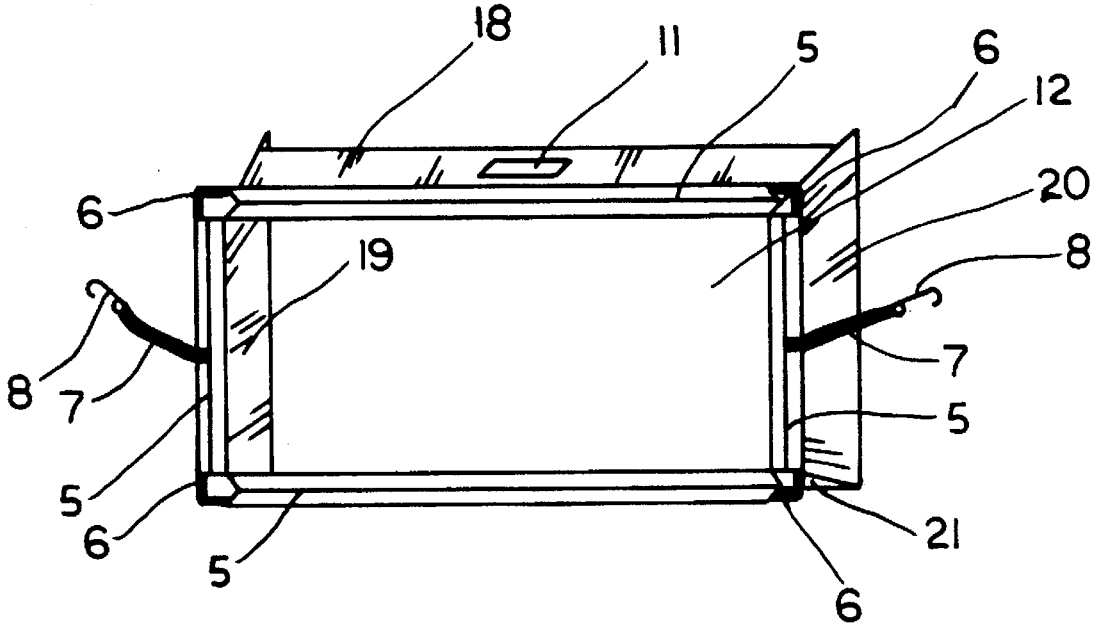
FIG. 3 shows an orthographic view of the forward component of the invention.
Figure 4:
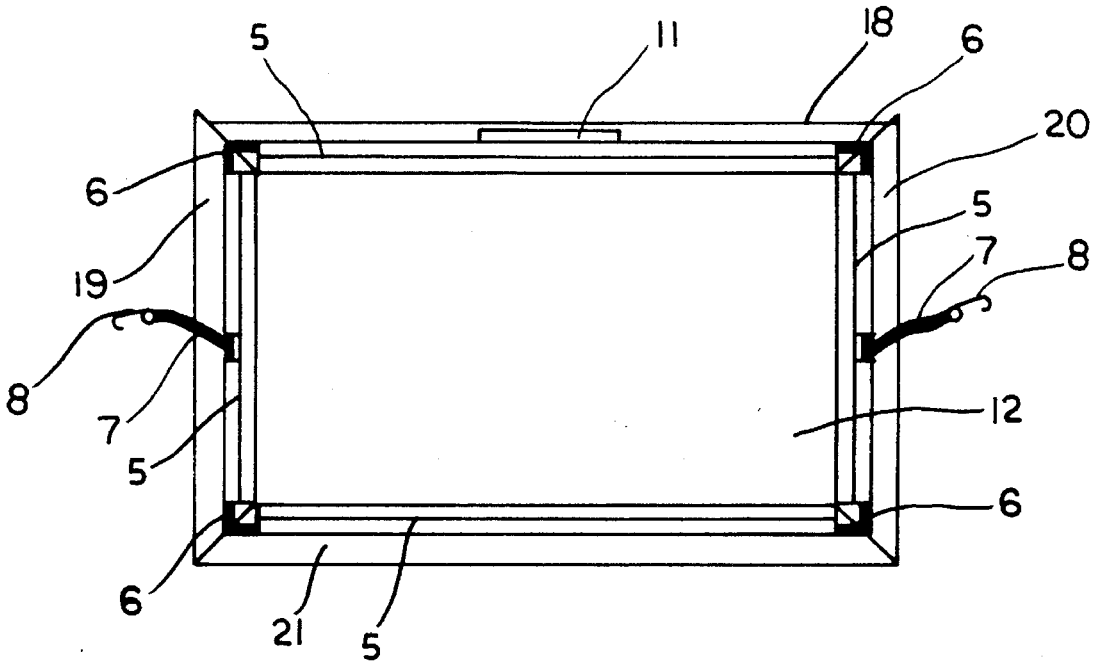
FIG. 4 shows a rear view of the forward component.
Figure 5:
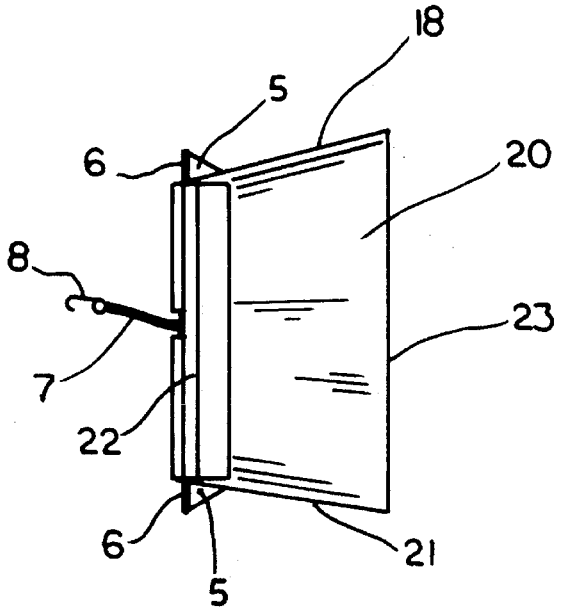
FIG. 5 shows a side view of the forward component of the invention having a plurality of grooves.

Referring now to FIG. 1, an apparatus for collecting leaves and debris 28 from a lawn or garden referred to generally by reference numeral 1. The apparatus 1 is make up primarily of a forward component 2, a rear component 3 and a reusable collection bag or a conventional and disposable trash bag 4.

The forward component 2 is comprised primarily of four panels including a top panel 18, a bottom panel 21, and a pair of lateral panels 19 and 20. The four panels of the forward component 2 form a substantially flared rectangular structure having a hollow center 12 to accept and channel leaves and debris 28 therethrough.

The four panels 18, 19, 20, 21 include leading edges 23 located at the front and a plurality of grooves 5 formed at the back edges of the forward component 2. The grooves 5 protrude from the forward component 2 and are positioned along the perimeter of the forward component 2.

A rectangular support member 6 is affixed thereto the grooves 5 along the outer border of the grooves 5 to give structural rigidity to the grooves 5. The support member 6 is necessary when the invention is made from materials such as corrugated paper or plastic. The support member 6 also serves as a site for attachment for a strap that will be described below. Along the side panels 19 and 20 of the grooves 5 are a pair of attachment sites 10 for allowing a flexible strap 7 to be affixed thereto at one end. At the opposite end of the flexible strap 7 is a hook 8 affixed thereto.

At the top panel 18 is a cut out hand hold 11 for allowing a person to grasp onto the invention, lift it and effectively seat the leaves and debris 28. Also, the cut out hand hold 11 enables a person to relocate the apparatus in an easy fashion. The cut out hand hold 11 will also allow the apparatus 1 to be hung from a nail or the like that is protruding from a wall, post or the like. The cut out hand hold 11 is typically located at the front edge of the top panel 18 that is forward with respect to the center of mass of the invention. The location of the cut out hand hold 11 when picked up by a person, enables the invention to tilt such that leaves and debris 28 will fall backwards through the forward component 2 and be channelled into the bag 4.

Referring now to the rear component 3, we see four panels 24, 25, 26, and 27 forming the basis of the structure 3. Each panel 24, 25, 26, and 27 has a corresponding leading edge 14, 17, 15, and 16 respectively located of the front. The four leading edges 14, 17, 15, and 16 form a rectangular border that have the same dimensions as the rectangular border formed by the grooves 5 of the forward component 2. At the opposite end of the leading edges is a substantially rectangular support member 9 affixed thereto the rear component 3. Integral foldover flaps 22 of the rear component 3 are used to hold the support member 9 to the rear component 3. A pair of attachment sites 10 are used to allow the hooks 8 of the forward component 2 a location to be attached thereto.

Figure 6:
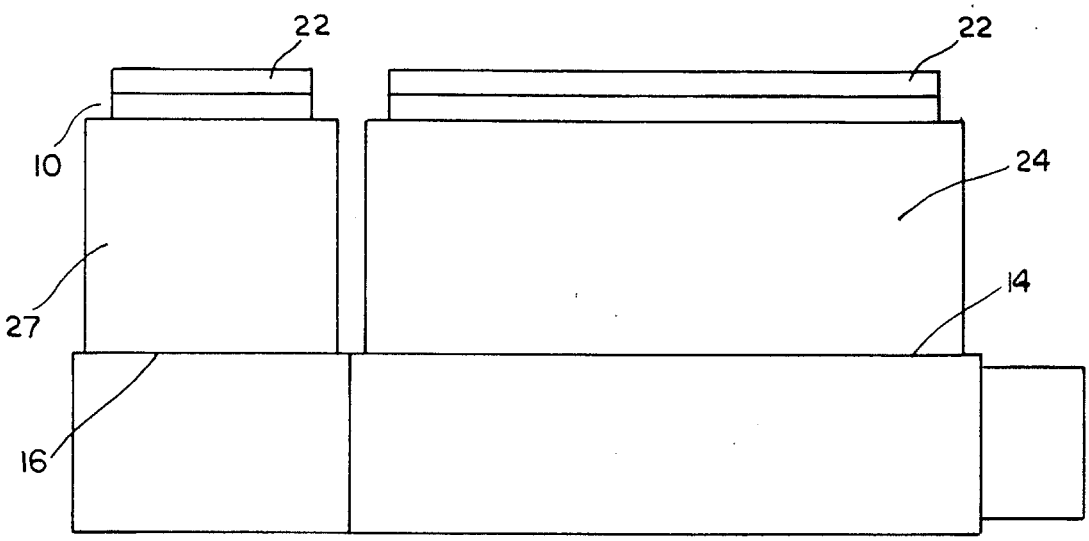
FIG. 6 shows one of the two identical templates that are used to construct the rear component.
Figure 7:
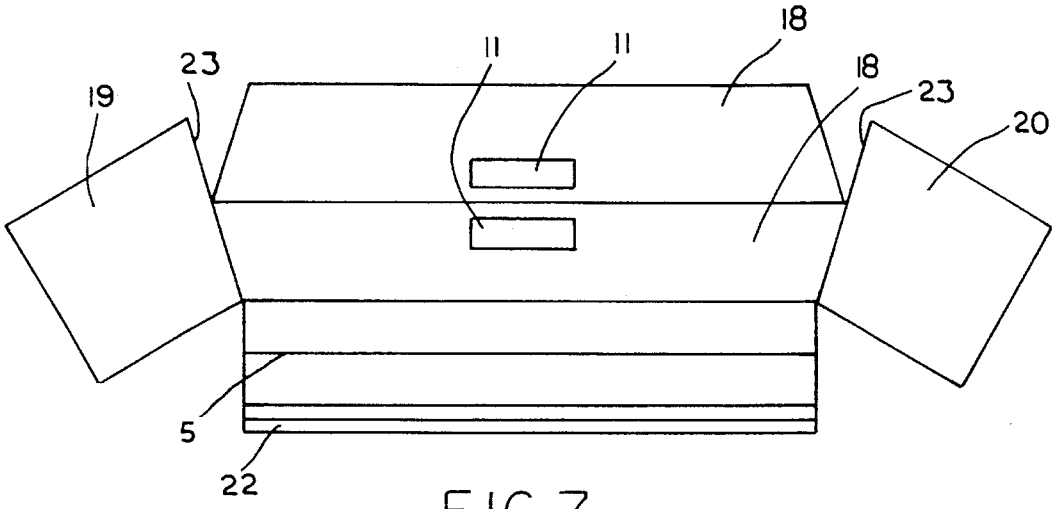
FIG. 7 shows a template used to construct the upper portion of the forward component.
Figure 8:
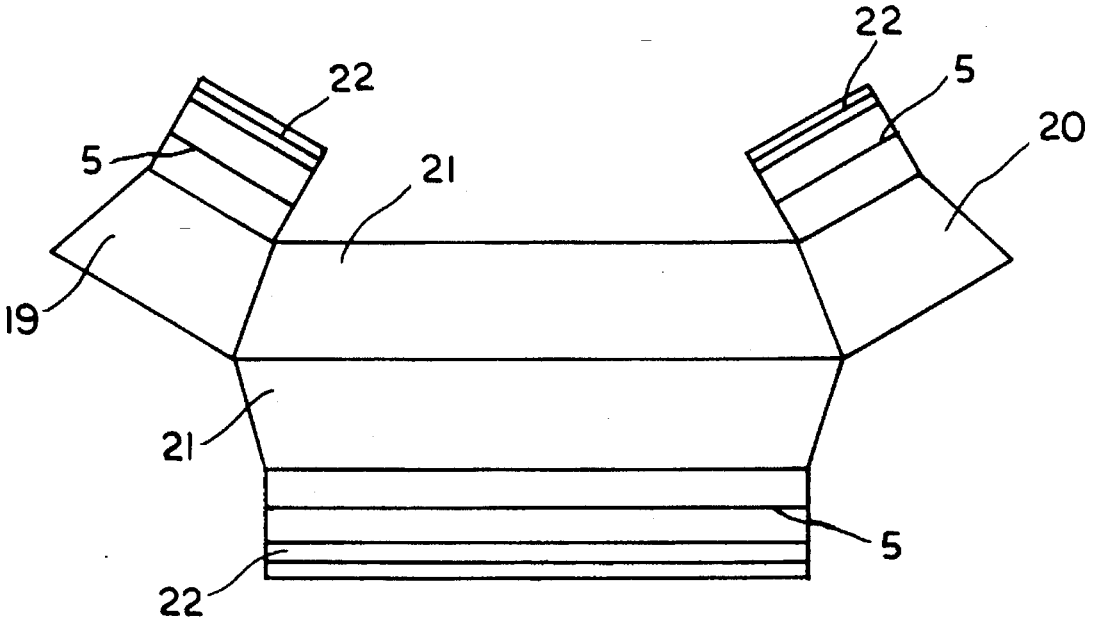
FIG. 8 shows a template used to construct the lower portion of the forward component.
Figure 9:
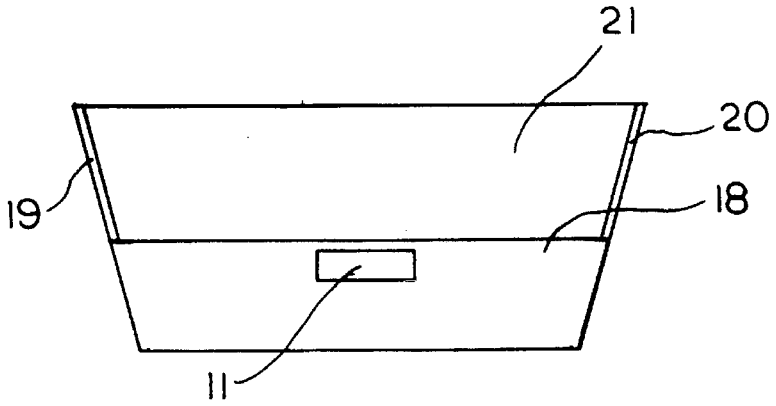
FIG. 9 shows a top view of the forward component with a recessed top panel.

If the invention is to be made from a material such as corrugated paper, corrugated plastic or the like, then the unfolded templates of FIGS. 6, 7, and 8 can be used to construct the funnelled receiver 1. In FIG. 6, a pair of identical templates are used to construct the rear component 3 of the funnelled receiver 1. The panels 24, and 27 are shown as well as leading edges 14, and 16. The foldover flap 22 are seen in an unfolded fashion.

Corrugated paper, corrugated plastic or the like templates used to construct the forward component 22 are shown by FIGS. 7 and 8. FIG. 7 shows a template that is used to construct the upper panel 18, the lateral panels 19 and 20 and the cut out hand hold 11. FIG. 8 shows a template that is used to construct the lower panel 21 and the lateral panels 19 and 20.

In carrying out this invention in the illustrative embodiment thereof, a person can normally construct the funnelled receiver 1 in the following manner. First a permanent, reusable collection bag or a conventional disposable trash bag 4 is opened and inserted therethrough the rear component opening 13 of the rear component 3 from the back to the front. The mouth of the bag 4 is then opened and folded over the rectangular perimeter formed by the leading edges 14, 15, 16, and 17. The leading edges 14, 15, 16, and 17 of the rear component 3 are then inserted into the grooves 5 of the forward component 2 whereby the mouth portion of the bag 4 is compressed therebetween. The hooks 8 of the flexible straps 7 are then pulled and attached onto the support member 9 at the attachment sites 10. The funnelled receiver 1 is now fully assembled and ready for use.

Conveniently, the user may place the assembled funnelled receiver 1 on the ground having the cut out hand hold 11 located at the top. The opening of the forward component 2 is placed facing the leaves and lawn debris 28 that is to be gathered and collected into the bag 4. The person then rakes the leaves and lawn debris 28 into the funnelled receiver 1 2 whereby the leaves and debris 28 are channeled therethrough and into the bag 4. Once the bag 4 is filled, the person can disassemble the funnelled receiver 1 via hooks 8 and remove the bag 4 when a disposable trash bag 4 is in use. The mouth of the bag 4 is then closed or sealed in the conventional manner to complete the task. When using the permanent, reusable collection bag 4, the person can empty the contents into a compost, trailer or another container for removal. Accordingly, a very unique, attractive, and convenient apparatus is provided for collecting lawn and garden debris 28 into a reusable bag or a conventional disposable trash bag.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A gardening apparatus for collecting leaves and debris, said apparatus comprising:

(a) a forward component having four panels, a front opening, a back opening, and a hollow center, said four panels having a bottom panel, two lateral panels, and a top panel, said four panels having front leading edges and back edges, said forward component having grooves formed thereto in proximity to said back edges, (b) a first substantially rectangular member affixed thereto said groove, (c) a rear component having four panels, a front opening, a back opening, and a hollow center, said four panels having a bottom panel, two lateral panels, a top panel, said four panels having front leading edges and back edges, said front leading edges fitting therein said grooves of said forward component, (d) a second substantially rectangular member affixed thereto said rear component in proximity to said rear edges, (e) a means of affixing said first member thereto said second member, said means comprising a flexible strap having one end affixed thereto said first member, and another end affixed thereto said second member, (f) a bag having an open mouth at one end, said open mouth of said bag affixed therebetween said leading edge of said rear component and said groove.

2. A gardening apparatus as set forth in claim 1 wherein said top panel having an opening therein in proximity to said leading edge thereby forming a hand hold.

3. A gardening apparatus as set forth in claim 1 wherein said top panel having a smaller surface area than said bottom panel top panel thereby allowing a person additional work area when raking leaves.

4. A gardening apparatus as set forth in claim 1 wherein said front opening of said forward component being larger than said back opening whereby leaves are easily channeled therein.

5. A gardening apparatus as set forth in claim 1 wherein said first member reinforcing the perimeter of said grooves of said forward component.

6. A gardening apparatus as set forth in claim 1 wherein said second member reinforcing the perimeter of said rear component.

7. A gardening apparatus as set forth in claim 1 wherein said flexible strap having a hook at one end for affixing said strap thereto said second reinforcing member.

8. A gardening apparatus as set forth in claim 1 wherein said grooves having a gripping means applied thereon for increasing friction between said bag and said grooves.

9. A gardening apparatus as set forth in claim 1 wherein said four panels of said forward component being flared from said back edges to said front edges.

* * * * *